United States Patent [19]

Vanmeggelen et al.

[11] Patent Number: 4,798,072

[45] Date of Patent: Jan. 17, 1989

[54] SPRING COILING MACHINE WITH DUAL ARBORS

[75] Inventors: Peter Vanmeggelen, Mississauga, Canada; John Jacobson, Southington, Conn.

[73] Assignee: Newcomb Spring Corp., Southington, Conn.

[21] Appl. No.: 80,638

[22] Filed: Jul. 31, 1987

[51] Int. Cl.[4] ..... B21F 3/10; B21F 11/00

[52] U.S. Cl. ..... 72/132; 72/138

[58] Field of Search ..... 72/129, 131, 132, 135, 72/138, 140, 142, 371

[56] References Cited

U.S. PATENT DOCUMENTS

| | | | |
|---|---|---|---|
| 1,816,880 | 8/1931 | Walton | 72/135 |
| 1,935,309 | 11/1933 | Bleuel | 72/132 |
| 2,119,002 | 5/1938 | Bergevin et al. . | |
| 2,385,357 | 9/1945 | Conrad . | |
| 2,455,549 | 12/1948 | Benjamin | 72/138 |
| 2,831,570 | 4/1958 | Haas . | |
| 2,925,115 | 2/1960 | Franks | 72/135 X |
| 3,294,125 | 12/1966 | Heine | 72/135 X |

*Primary Examiner*—E. Michael Combs

*Attorney, Agent, or Firm*—Chilton, Alix & Van Kirk

[57] ABSTRACT

The present invention is directed to a spring coiling machine, a chuck or tool holder for a coiling machine, and a method of operating a coiling machine, which, in their broadest aspects, utilize two vertically spaced apart arbors of different construction. The first is a stationary form arbor and the second is a lower, retractable cutting arbor. The form arbor is continuously employed to produce the desired radius of curvature, or turn diameter in conjunction with the coiling point, whereas the cutting arbor is normally in a retracted position and is extended into its deployed or cutting mandrel position, only when the coil has been fully formed and it is to be severed. The reciprocating motion of the cutting arbor is preferably effectuated by utilizing the conventional cam controlled features of the machine that are normally used to control the pitch tool.

19 Claims, 4 Drawing Sheets

SPRING COILING MACHINE WITH DUAL ARBORS

BACKGROUND OF THE INVENTION

This invention relates to spring coiling machines, and more particularly, to coiling machines set up to produce relatively small springs of non-uniform diameter.

The basic construction and operating principles of spring coiling machines today closely follow those set forth in representative U.S. Pat. Nos. 2,119,002 issued May 31, 1938, for a "Spring Coiling Machine", and 2,831,570 issued Apr. 22, 1958, for "Wire Coiling Machine Having Cams for Holding The Feed Rolls Separated". In the coiling machine described in U.S. Pat. No. 2,119,002, features are described which permit the operator to adjust the initial settings and cam-controlled movement of various tools and devices that affect the characteristics of the fabricated coil springs. These characteristics can include a uniform or variable spacing between turns, and a uniform or variable turn diameter.

In such conventional machine, a round or square wire is fed through a guide block to a coiling point which plastically deforms the wire against an arbor. Typically, the wire is shaped into a continuous series of turns or loops, until the desire length of helical coil has been turned. A cut off blade is then actuated to sever a portion of the last-formed turn against the arbor. The forming diameter of the individual turns or loops in the coil is controlled by the distance between the coiling point tool and the arbor, and the size of the arbor.

Although machines of the type described above perform satisfactorily for most applications, difficulties have been encountered in setting up and operating such machines to produce small gage springs having nonuniform loop diameters. This problem arises from the conflicting requirements that an arbor having a very narrow nose is required for producing a tightly wound loop, but such a narrow arbor is somewhat delicate and susceptible to breakage as a result of the cutting blade impacting the wire against the arbor to sever the coil from the wire supply. This problem is particularly difficult in situations where the cross-sectional area of the minimum axial clearance through the coil is only about four times the cross sectional area of the wire.

An additional difficulty with conventional coil spring machines is that when forming coils with a square wire, the compressive stress imposed on the wire as it passes between the guide block and the arbor, tends to flatten the inside square edge. Although in some situations this may be desirable, in other situations, such as the fabrication of coil springs to be mounted in plastic caps to form connectors for electrical conductors, it is desirable that the wire retain a relatively sharp edge on the inside surface of the coil. Moreover, in this particular application, it is desirable that the inside edge of the coil wire not only retain a degree of sharpness, but that the inside edge also have a slight vertical tilt to increase the capability of the connector to resist pull-out of the conductors secured therein.

Conventionally, this tilt on the inside edges of the square wires for electrical connector springs, has been introduced by the pitch tool after the wire has passed the arbor. Although this technique has been marginally effective for producing the desired tilt, it has no beneficial effect on the problems mentioned above, regarding the frequent breakage of arbors due to the small sizes required to form the minimal coil diameter, and the blunting of the edges on the square wire before it reaches the pitch tool.

SUMMARY OF THE INVENTION

In its various embodiments, the present invention is directed to a spring coiling machine, a chuck or tool holder for a coiling machine, and a method of operating a coiling machine, which, in their broadest aspects, utilize two vertically spaced apart arbors of different construction. The first is a stationary form arbor and the second is a retractable cutting arbor. For producing right hand wound springs, the upper arbor is stationary, and the lower arbor is retractable. For left hand wound springs, this relationship is reversed.

The form arbor is continuously employed to produce the desired radius of curvature, or turn diameter in conjunction with the coiling point, whereas the cutting arbor is normally in a retracted position and is extended into its deployed or cutting mandrel position, only when the coil has been fully formed and it is to be severed. The reciprocating motion of the cutting arbor is preferably effectuated by utilizing the conventional cam controlled features of the machine that are normally used to control the pitch tool.

In the preferred tool holder or chuck embodiment of the invention, the chuck contains four holes, formed perpendicular to the face of the chuck. The first hole is for mounting the form arbor, the second for mounting the block wire guide holder, the third for mounting a pitch tool, and the fourth for mounting the cutting arbor. The cutting arbor is somewhat similar to a conventional pencil arbor, mounted so that the point of the nose portion is above the arbor stem center line. The arcuate, tapered portion of the nose faces the coiling point, with the flat cutting plane portion facing away from the coiling point. The form arbor is of a different construction, having no cutting plane, but rather a fully arcuate tapered nose oriented such that the point of the nose is below the center line of the arbor. Thus, the points of both arbors are adjacent one another between the center lines of the arbor stems.

Particularly when used to form coil springs from square wire where it is desirable to maintain the sharpness of the edges on the internal surface of the coil, the form arbor is machined to have a tapered profile angled less than about 45 degrees relative to the stem centereline, preferably about 40 degrees. As the square wire is fed over the tapered, arcuate surface of the form arbor, a slight twist is imparted. This twist remains in the wire as it passes the coiling point and pitch tool, so that it assumes a permanent form inside the coil.

Another feature of the tool embodiment of the present invention is a unique block wire guide holder that includes a deflection surface located substantially above and somewhat forward of the arbor points, for influencing the shape of the trailing edge of the coil at the cutline. The deflection surface is located such that as the cutting blade lifts the last-formed turn during its cutting action, the lifted portion of the wire contacts the deflection surface, and assumes a kink which affects the way in which the trailing edge is deformed during the cut. A properly placed deflection surface can produce a slightly outward burr in the trailing portion of the coil, when this is desired.

Yet another feature of the tool holder in accordance with the invention, is a stationary pitch tool that is generally wedge shape and has a contoured surface for contacting a loops it emerges from the coiling point. This permits a non-uniform pitch within a given coil, without necessitating reciprocal movement of the pitch tool. The camming arrangement normally used for moving the convention pitch tool, is instead dedicated to reciprocating the cutting arbor.

The method embodiment of the invention, in its broadest form, includes the steps of mounting two arbors of different construction in vertical side by side relationship, feeding a wire over the upper arbor and deflecting the wire at a coiling point to produce at least one minimum diameter turn, moving the coiling point away from the upper arbor to form subsequent turns having an increased diameter, extending the lower arbor into a position between the upper arbor and a portion of the turn at a position past the coiling point, and severing this portion between the moving blade and the lower arbor. After the step of severing the formed coil, the lower arbor is retracted either immediately, or at least at a point in time before the minimum diameter turn is to be formed on the next coil.

The present invention is particularly well suited to forming small coil springs of the type utilized in plastic cap electrical connectors, where a modified hour glass coil shape is commonly employed. Such coils have a first end diameter suitable for insertion contact at the dome of the cap, and a second end having a larger diameter, for receiving the electrical conductors to be joined. It is desirable that the coil be manufactured from a square wire, and that the edge portions of the wire maintain a suitable degree of sharpness after forming the inner surface of the coil. Also, it is desired that the trailing cut edge of the coil at the second end, have a slightly outward projection or burr that can bite into the plastic cap and prevent rotation of the coil within the cap.

With the present invention, the first turn at the first end is formed and cut as a result of the last step in the formation and cut off of the previously formed coil. At this moment, both arbors are in the deployed position in the tool holder. The cutting arbor is then immediately withdrawn so that the coil diameter can be decreased from the first end to the minimum diameter portion and thereafter increased. As the second end of the coil is about to be formed, the cutting arbor is extended and the cutter blade is actuated to sever a completed coil from the feed wire. The cutting arbor is again immediately withdrawn and the coiling point is moved toward the stationary form arbor to again form the first turn. Although a small portion of the first turn of the wire has a curvature corresponding to the outer diameter of the second end of the just cut-off coil, the coiling point quickly moves to a smaller diameter position and, by the time a complete turn has been formed, the diameter of the first end is considerably smaller than that of the just-severed second end of the previously formed coil.

BRIEF DESCRIPTION OF THE DRAWINGS

These and other features and advantages of the preferred embodiment of the invention will be described in detail below, with reference to the accompanying drawings, in which.

DESCRIPTION OF THE PREFERRED EMBODIMENT

A preferred embodiment of the invention will be described with reference to a single point spring coiling machine such as model W11A available from the Torin Corporation, Torrington, Conn., but it should be understood that the principles and advantages of the invention are equally valid for other makes of coiling machines. The basic operating features and principles of the Torin machines are described in U.S. Pat. No. 2,119,002, the disclosure of which is hereby incorporated by reference. The following description is, for convenience, made with reference to the manufacture of a right-handed coil or spring, but it will be evident to those familiar with this technology that the description applies equally to the manufacture of left-handed coils, by reversing the mounting or orientation of parts and tools such as the guides, arbors, cutters, etc.

A typical coiling machine of the type described in the '002 patent has a multiplicity of gears, linkages, levers, cams and power supplies, all of which are operatively connected for the purpose of feeding a wire to a coiling station where the wire is plastically deformed into a coil. The coil is then cut and the sequence is repeated so that many coils can be produced without interruption.

Figure 1:
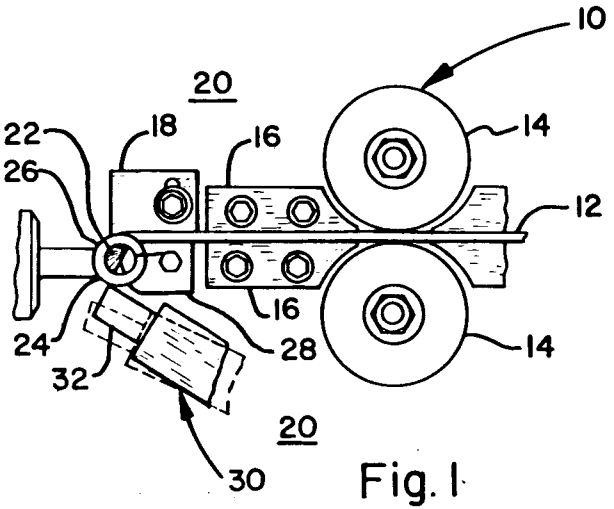
Fig. 1 PRIOR ART
FIG. 1 is a schematic illustration of the cutting station in a conventional single point coiling machine, set up for producing a right-handed, coil.

FIG. 1 represents the coiling station 10 of such a machine, including a wire 12 displaced to the left by feed rolls 14, through wire guides 16 and block wire guides 18. The wire is progressed parallel to the front face or panel 20 of the machine, until it reaches the arbor 22, which is mounted in the face of the machine and extends outwardly toward the operator. A coiling point 24 contacts the wire as it emerges from between the arbor 22 and the block guide 18, such that the wire is forced to assume a plastic deformation and a generally helical shape. In FIG. 1, the coil 26 is shown as an annulus around the arbor, but it should be understood that the coil extends outwardly from the plane of the figure. A pitch tool 28 is wedged at an angle through the wire as it passes around the arbor, thereby establishing the pitch, or relative spacing between successive loops or turns in the coil. When the coil 26 reaches the desired number of turns (or length), a cutting tool 30 having a projecting cutting blade 32 is actuated from the lower left to the upper right in the figure, to sever the feed wire and complete the fabrication of the coil.

Not shown, but understood as being present, are controllers for moving the coiling point 24 toward and away from the arbor 22, thereby controlling the diameter of a given loop or turn, and a controller for the pitch tool 28, typically moving it toward or away from the front of the machine, thereby controlling the coil pitch. The structures for attaching, connecting, and controlling the fixed and moving parts depicted in FIG. 1 are well known in the art and are more fully described in the referenced patent.

Figure 2:
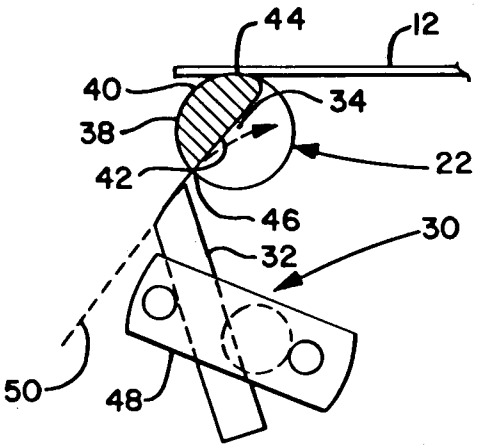
Fig. 2 PRIOR ART
FIG. 2 is a schematic illustration of the arbor and cutting tool of a typical coiling station of the type shown in FIG. 1.
Figure 3B:
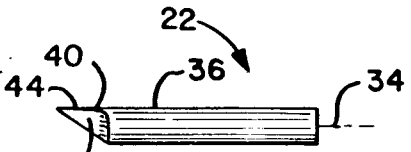
FIGS. 3 (*a*) and (*b*) are two views, ninety degrees apart in rotation, of a convention pencil arbor suitable for use as a cutting arbor with, the present invention.
Figure 3A:
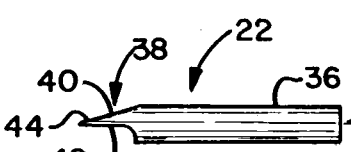

FIG. 2 depicts in greater detail, the conventional arrangement for severing a completed right-handed coil. The arbor 22 is shown partly in section, as viewed from the front along the stem axis or centerline 34, and the other features thereof may be more readily understood with reference to FIGS. 3 (*a*) and (*b*). Such a conventional, or pencil arbor has a stem portion 36 mounted in the tool holder portion of the machine, and includes a nose 38 which has a semi-arcuate tapered portion 40 and cut away, planar portion 42. The curved or arcuate portion 40 as viewed in section in FIG. 2 provides a smooth surface around which the wire is initially coiled. Typically, a groove is provided as at 44 in conventional pencil arbors when they are used in a conventional, single arbor chuck. Opposite the coil forming surface 40 is the cutting plane 42 oriented at a suitable angle anywhere between vertical and approximately 45 degrees from the vertical. The groove 44 and coil forming surface 40 are above the stem centerline 34, whereas the cutting mandrel surface 46 is below the stem centerline.

The cutting mandrel surface 46 of the pencil arbor 22 is used in conjunction with the cutting tool 30 to sever the wire after the coil has been completed. The cutting tool 30 includes a blade holder 48 which is cam actuated as is well known in the art, and a blade 32 which is adjusted to move in an arc 50 with slight clearance against the cutting mandrel surface 46.

FIG. 2 illustrates the source of one of the problems associated with prior art machines. When the arbor nose 38 is required to be narrow for producing small diameter coils, the force of the blade 32 as it severs the wire against the cutting mandrel surface 46, generates significant stresses on the nose 38 and causes frequent breakage. With known techniques, the curvature of the coil forming surface 40 of the arbor must be no greater than the curvature of the minimum diameter portion of the coil. If the desired coil is to have a non-uniform diameter and the end of the coil is to have a significantly larger diameter than the minimum diameter, the arbor was sized to produce the minimum diameter loop, but such arbor size was generally too small for optimum orientation and ruggedness needed for severing the coil at the maximum diameter.

Figure 5A:
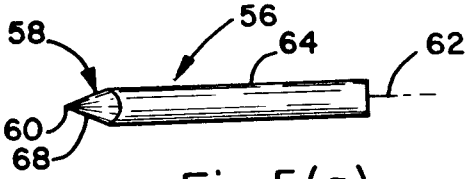
FIGS. 5 (*a*) and (*b*) are two views, rotated ninety degrees relative to each other, of the form, or pin arbor associated with the present invention.
Figure 5B:
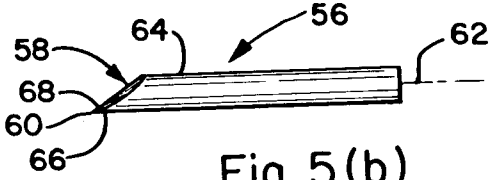
Figure 4:
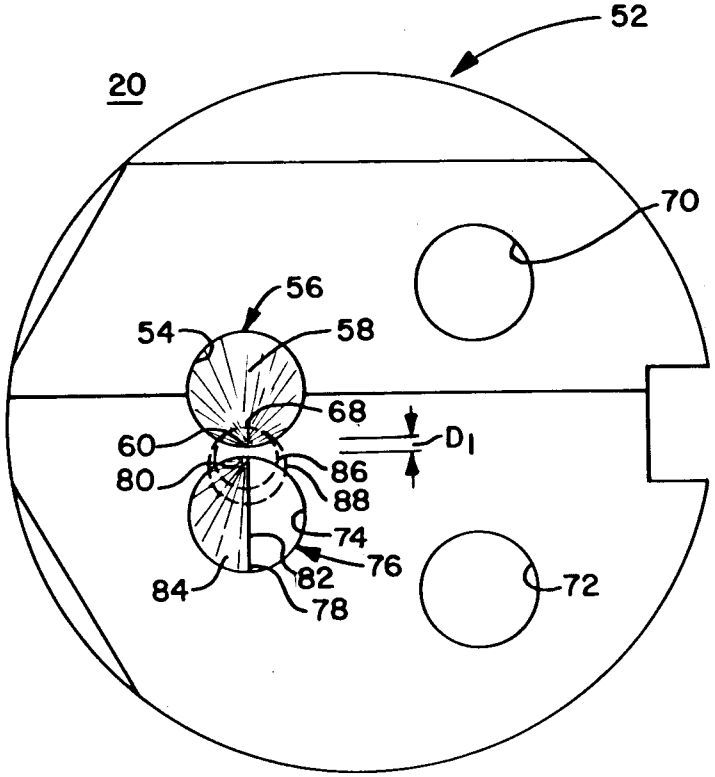
FIG. 4 is a schematic layout of a chuck or tool holder in accordance with the present invention, for installation in the cutting station of a conventional coiling machine of the type depicted in FIG. 1.

In accordance with the present invention, the cutting station 10 of the typical spring coiling machine is modified by providing a new tool holder having provision for mounting two distinct arbors. The front face of a tool holder 52 suitable for use with the coiling machine referred to above, is shown in FIG. 4. A first hole 54 is provided for the stationary mounting of a form arbor 56, which has a unique nose 58 as shown in FIGS. 5 (*a*) and 5 (*b*). In FIG. 4, the form arbor is mounted so that the point 60 is below the centerline 62 of the stem 64, and vertically aligned therewith. The nose 58 has a fully arcuate taper (no cutting plane), and the bottom of the nose has a flat profile 66. In the embodiment described herein, no grooves are provided on the nose. The wire (not shown) is fed toward the left so that it rests low on the arcuate, tapered portion of the nose, as at 68, rather than on a horizontal portion such as groove 44 in FIGS. 3(*a*) and (*b*), as is conventional. Thus, the pin arbor 56 of the present invention has a shape different from and is oriented in 80 rotation relative to, conventional pencil arbors.

The second hole 70 in the tool holder 52 is provided for mounting the block wire guide holder, and the third hole 72 is provided for mounting a pitch tool (as will be described in connection with FIGS. 9 and 10). The first, second, and third holes 54, 70, 72 described above are normally provided on the tool holders used in connection with a conventional coiling machine. It should be understood, however, that with the present invention, at least some of the tools mounted therein are not conventional.

A new, fourth hole 74 is provided in the tool holder, preferably vertically aligned beneath the first hole 54, for mounting a slightly modified conventional pencil arbor 76. The pencil arbor 76 is linked within the machine to a cam system for reciprocal movement between a withdrawn position that is flush or recessed relative to the face of the machine, and an extended position as shown in FIG. 4, generally co-extensive with the projection of the form arbor 56 toward the operator. The pencil arbor 76 is deployed in the extended position for the purpose of providing an appropriate cutting mandrel surface 78 generally analogous to the arrangement between the mandrel cutting surface 46 and the cutting tool 30 as shown in FIG. 2.

During the formation of the minimum diameter loop portion of the coil, and preferably during the formation of substantially all of the coil except immediately preparatory to coil cut-off, the cutting arbor is maintained in the withdrawn position. During this stage of operation, the pin arbor 56 alone is used as a form arbor, providing a coil forming surface at 68 with a very small radius of curvature. As the coil formation continues, the coiling point (not shown in FIG. 4) is moved toward the left and the loop or turn diameters increase. At any time after the turn or loop diameter exceeds D1 (the distance between the fully extended arbor points 60,80), the cutting arbor 76 may be extended and the coil severed from the feed supply.

Thus, the loop having the coil minimum diameter is formed when only the form arbor 56 is deployed whereas during the formation of larger diameter loops, the cutting arbor 76 may be deployed. The timing of the extension and withdrawal of the cutting arbor 76 is accomplished by appropriate linkage to the cam that normally controls the taper or pitch tool, which is described in the '002 patent (see page 4 beginning at line 65 thereof). This adaptation is well within the skill of those who set up such machines.

The cutting plane 82 of the cutting arbor 76 as shown in FIG. 4 is preferably vertical and passes through the center of the nose point 80 and intersects the stem axis 62 of the form arbor 56, but other angles may also prove beneficial. The trial and error optimization of the rotational orientation of the cutting arbor relative to the form arbor, and minor grinding thereof, are well within the skill and practical knowledge of the practitioners in this art.

The relative sizes of the form arbor nose 58 and the cutting arbor nose 84 in a given plane parallel to the face of the machine, depends on a variety of production-related factors that are also within the skill of the practitioner to determine. The present invention is particularly beneficial, however, where the form arbor 56 must be of small cross section in order to form a small minimum diameter loop, whereas the cutting arbor 76 size can be commensurate with a larger diameter loop of the coil, on which the cutting will be accomplished. Thus, the delicate nose 58 of the form arbor does not undergo any impact stresses whereas the larger cutting arbor nose 84 can accommodate such stresses and provide a long useful life.

In FIG. 4, the dashed circles show the diameters of two different turns or loops 86, 88, indicating the relatively larger cross sectional area of the cutting arbor 76 than the form arbor 56, included within the turns. Similarly, the vertical plane passing through the forming surface 68 (defined by the feed wire centerline in FIG. 10) cuts a larger section of the cutting arbor than the form arbor. Turns 86, 88 represent relatively large turns of the coil; the minimum diameter turn would have a diameter less than D1.

Figure 6:
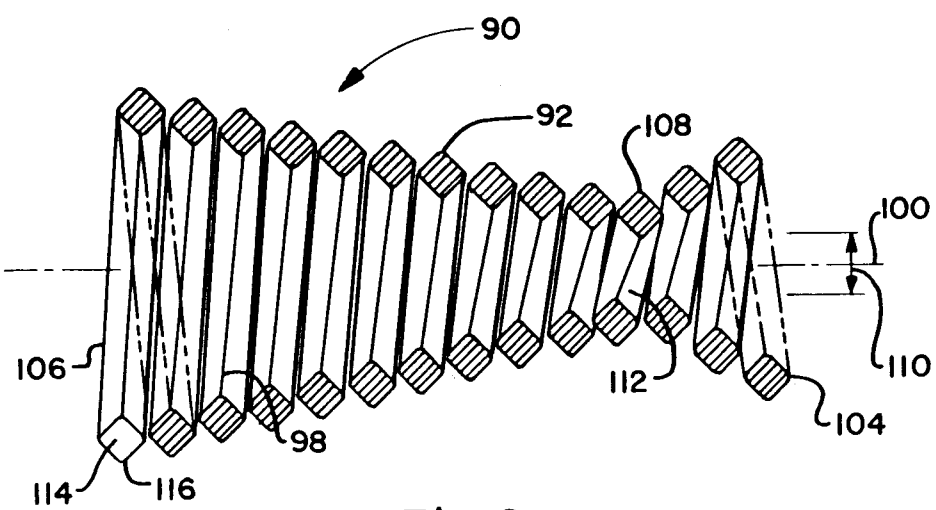
FIGS. 6 is a longitudinal section view, taken along lines 6—6 of FIG. 7, illustrating an example of one type of spring coil that can readily be produced with the present invention.
Figure 8:
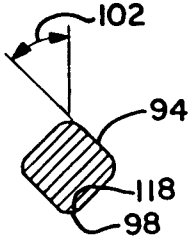
FIG. 8 is a cross-sectional view of a typical square wire used in the fabrication of the coil spring shown in FIG. 6.
Figure 7:
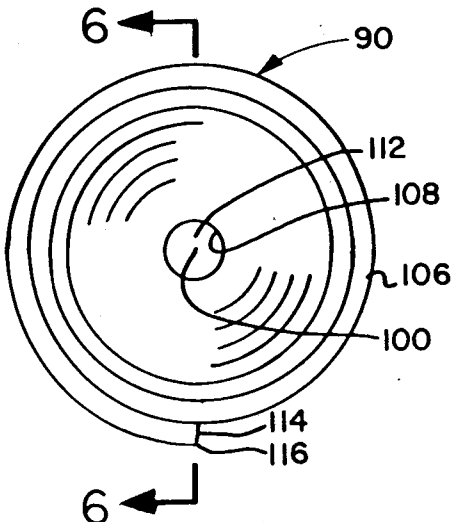
FIG. 7 is an end view of the spring shown in FIG. 6.

FIGS. 6, 7 and 8 illustrate in greater detail, the type of coil spring 90 that is particularly well suited for fabrication by the apparatus and method of the present invention. The spring 90 is of a modified hourglass profile, having thirteen helical turns or loops 92. The wire 94 is of square cross section, 0.036 inch per side and of conventional spring steel. The overall length of the spring is about 0.650 inch. The inside surface of the spring has the inside edge 98 of the wire directed inwardly towards the spring axis or centerline 100. With reference to the wire section view of FIG. 8, it is further desirable that the inside edge 98 be tilted a few degrees as indicated at 102, so that the edges inside the coil tilt toward the coil top, or first end 104.

The approximate outer diameter of the first turn or end 104 is 0.261 inch and the approximate outer diameter of the second, or bottom turn or end 106 is 0.365 inch. The portion 108 of the spring having a minimum inner diameter 110 is near the first end, with the minimum inner diameter being approximately 0.107 inch. Thus, the cross sectional area of the central opening 112 at the turn 108 of minimum spring diameter 110, spans an area that is only about four times the cross sectional area of the wire.

FIG. 6 also shows the orientation of the spring 90 at the moment of completion of the coiling thereof on the coiling machine, if it is assumed that the coiling point and arbor are at the left. Thus, the sequence of coiling of the spring begins at the leading or first end 104 and terminates at the trailing, or second end 106. It should be evident that the severed edge associated with the first turn 104 of a given coil is formed by the cutting action on the trailing edge 114 of the preceding coil.

As will be more fully explained below, the invention provides special features for giving this trailing edge 114 a slightly outwardly directed burr 116. Another requirement often imposed by the customer, is that one or more edges, particularly the inside edge 98 of the wire, maintain an acceptable sharpness after it has been wound into a coil. For example, the edge radius of curvature 118 of the wire supply is typically 0.004 inch, and must be maintained within about 0.006 inch radius after coil formation.

Figure 9:
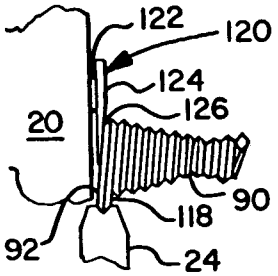
FIG. 9 is a schematic view taken from above the coiling station with the block wire guide removed, showing the relationship of the feed wire, form arbor, coiling point, and pitch tool in accordance with the preferred embodiment of the invention.

FIG. 9 is a top view of the coiling station with the block wire guide removed for clarity. Only the form arbor 56 is visible, hidden in part by the wire 94 which is moving into forming contact with the coiling point 24. The centerline of the feed wire 94 and the center of a groove 118 on the coiling point are typically aligned, so that the coiling, or helical nature of the spring is produced by the pitch tool 120. In the illustrated embodiment, the pitch tool stem 122 is mounted in the third hole 72 (FIG. 4) and has a wedge-like head 124 with a contoured upper surface 126 extending substantially parallel to the face of the machine against the lower surface of each loop portion 92 as it emerges from the coiling point 24. The desired pitch between adjacent loops is in effect determined by the thickness of the contoured wedge portion 126 as a function of the loop diameter.

The cutting arbor can also be used to pitch the spring. By having the arbor extend to a point where the wire is forced over it, a pitch in the coils can be produced. This is useful when a variable pitch, or a pitch that cannot be produced with the stationary pitch tool, is required. The shape of the arbor is changed accordingly to the pitch required. The cut-off portion essentially remains the same. The area next to the cutting point is shaped so that the pitch required can be produced.

Figure 10:
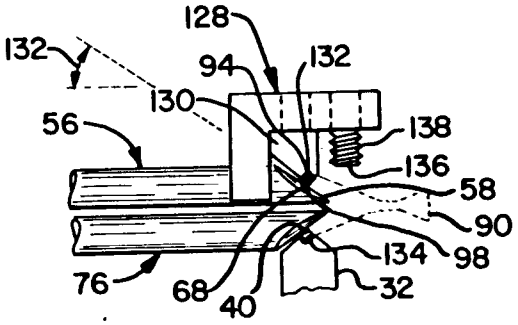
FIG. 10 is a schematic side view of the coiling station with the coiling point removed, showing the relationship of the block wire guide holder, form and cutting arbors, and cutting blade, in accordance with the preferred embodiment of the invention.

FIG. 10 is a side view from the position of the coiling point, showing the profiles of the form and cutting arbors 56, 76 just prior the cutting of the last turn 106 of a completely formed coil 90 (represented in outline by broken line). The block wire guide holder 128 rigidly secures the block wire guide 130 with appropriate clearance relative to the arcuate, tapered nose portion 58 of the form arbor 56. The guide notch 132 on the wire guide 130 is vertically oriented, but the taper angle 134 of the arcuate nose portion 58 is preferably less than 45 degrees, preferably about 40 degrees. As the wire 94 moves along the nose surface at 68, a slight tilt is imparted to the wire, in the direction shown by angle arc 102 in FIG. 8. This arbor nose portion 58 contacts the flat side of the wire and the degree of tilt in the wire can be changed by changing the taper angle of the nose portion 58.

Below the form arbor 56 can be seen the cutting arbor 76 in the extended position. The cutting blade 32 preferably has a notch 134 in substantial vertical alignment with the notch 132 on the wire guide. The most recently formed loop 106 is cut as the blade 32 pinches it against the mandrel surface 78 of the cutting arbor nose 84, which moves upward and into the plane of the paper, as viewed in FIG. 10 (see also FIG. 11). As is well known, the wire guide 130, cutting arbor nose 84, and coiling point (not shown) may be appropriately ground to provide the required clearances.

Figure 11:
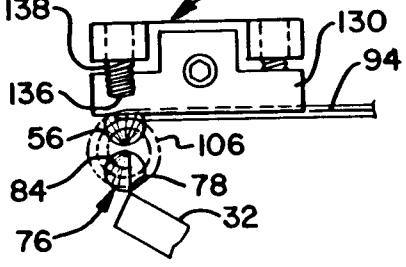
FIG. 11 is a front view of the block wire guide holder depicted in FIG. 10.
Figure 12:
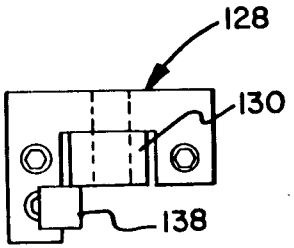
FIG. 12 is a top view of the block wire guide holder depicted in FIG. 11.

FIGS. 10, 11, and 12 further show a deflecting surface 136, at the lower end of a threaded bolt 138 or other adjusting member, which is mounted on the wire guide holder 128 above and slightly forward of the loop segment to be severed, e.g., slightly forward and above the point 68 of the form arbor 56. The purpose of the deflecting surface 136 is to influence the characteristics of the severed edge 114 of the last loop 106 of the coil 90. In FIG. 11, the outline of a portion of the coil including last loop 106 is shown, with the cutting blade 32 about the cut the wire.

Figure 13B:
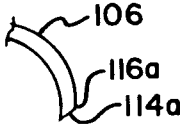
FIGS. 13 (*a*) and (*b*) illustrate schematically the instantaneous displacement of the end loop portion of a coil during the conventional cutting operation, and thereafter, the resulting shape of the trailing edge.
Figure 13A:
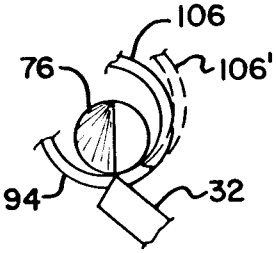

FIG. 13 (*a*) shows the observed movement of the coil end portion 106 as it is severed from the wire 94 remaining behind the cutting arbor 76 without the presence of the deflection surface 136. During contact with the blade 32, the portion 106 is lifted upwardly and to the right, as indicated at 106, in phantom, until the cutting action is complete. After the cut, the portion 106 rebounds elastically to a position adjacent the next preceding turn (not shown). FIG. 13 (*b*) shows the typical cut 114*a* resulting and outer edge 116*a*.

Figure 14B:
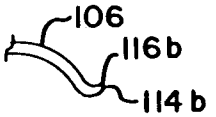
FIGS. 14 (*a*) and (*b*) correspond respectively to FIGS. 13 (*a*) and (*b*), when the deflection surface is present in accordance with the invention, to produce an outward burr on the trailing edge.
Figure 14A:
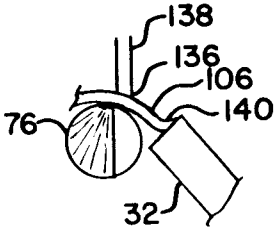

It is often desirable, however, to form an outwardly directed burr or rim on the cut edge. Although desirable, this has in the past been virtually impossible to achieve as an integral part of the cutting or forming operation. In accordance with the present invention, however, the deflecting surface 136 is utilized to interrupt the upward displacement of the end portion 106 and cause a kink 140 or other elastic inflection that affects the angle at which the blade severs the wire. This is schematically illustrated in FIG. 14 (*a*) which shows that the end portion 106 has been stopped by the deflection surface 136, which also has the effect of stiffening the tip area 140. This stiffening causes the blade 132 to deform the cut end 114*b* outwardly such that when the cutting action is complete and the end portion springs back, it has a slightly outwardly directed burr or rim 116*b*, as shown in FIG. 14 (*b*).

The deflecting surface 136 on the deflection member 138 is preferably centered on the plane passing through the centerlines of the arbors 56, 76 but this is not absolutely necessary. The position can be adjusted to deflect the wire turn 106 by trial and error to obtain optimum results. The threaded deflection member 138 can be used to perform the trial and error setup, but in a production mode, it is preferable to mount a carbide tip at the optimum distance and orientation based on the geometry represented in FIG. 10. It has been found that the wire portion 106 should be permitted to rise slightly during the initial stages of the cut. The deflection surface angle 136 should be approximately parallel to the taper angle 134 of the form arbor 56.

The machine and the tool holder for the machineas described above, operate in a sequence of novel movements. More specifically, a wire 94 is fed to a first arbor 56 around which it is deformed into a coil 90 configuration by interaction of a coiling point 24, the arbor 56, and the wire guide 130. After the minimum diameter portion 110 of the coil has been formed, and at some point in time before the coil is to be severed on a last-formed loop 106 having a diameter larger than the minimum diameter, the cutting arbor 76 is inserted on the inside surface of such last-formed loop 106. A cutting blade 32 is then actuated to sever the last-formed loop 106 between the blade 32 and the cutting arbor 76.

In a preferred embodiment, the last-formed loop 106 is caused to hit a deflection surface 136 during the time the blade is in contact therewith, whereby a kink 140 or other deflection is produced so that an outwardly directed burr 116*b* can be achieved as described above. Also according to the method, the form arbor 56 is maintained in a stationary position, whereas the lower, or cutting arbor 76 is deployed into cutting position within the coil 90 only at certain times during the coil fabrication cycle.

As described above, the method preferably includes the step of tilting the edges 98 of a square feed wire 94 on a tapered nose portion 58 of the form arbor 56 so that the axes of the wire are not strictly vertical and horizontal as the wire is bent around the arbor nose 58 as it is given the desired curvature.

We claim:

1. A spring coiling machine having a front panel including a coiling station, comprising:
   (a) a form arbor having a nose projecting from the panel;
   (b) a block wire guide in close vertical spaced relation to the form arbor;
   (c) a coiling point in close side spaced relation to the form arbor;
   (d) a pitch tool in close side spaced relation to the form arbor, opposite the coiling point;
   (e) means for feeding a supply of wire between the wire guide and the form arbor, between the coiling and the form arbor and against the pitch tool, such that during said feeding the wire is plastically deformed into a coil having a series of adjacent generally helical turns;
   (f) blade means operative downstream of the coiling point for severing a coil from the supply of wire;
   (g) means for controlling the position of the coiling point during coil formation, to produce a coil having turns of different diameter;
   (h) a retractable cutting arbor situated between the form arbor and the blade means, the cutting arbor operative in a retracted position within the panel during the forming of small diameter turns, and movable to an active position projecting from the panel into a large diameter turn to provide a cutting mandrel against which the blade means can sever said large diameter turn from the supply of wire, the timing of the retracting motion of the cutting arbor being responsive to the means for controlling the position of the coiling point; and wherein the form arbor nose has an arcuate, tapered portion in contact with the feed wire, and a flat profile portion facing the cutting arbor.

2. The coiling machine of claim 1, wherein the form arbor nose terminates in a point located below the form arbor centerline, and the cutting arbor has a nose that terminates in a point located above the cutting arbor centerline.

3. The coiling machine of claim 1, wherein the angle of the arcuate tapered portion of the form arbor nose is less than 45 degrees from the horizontal.

4. The coiling machine of claim 3, wherein the centerlines of the form arbor and the cutting arbor are vertically aligned, and the cross sectional area of the cutting arbor is larger than the cross sectional area of the form arbor in the vertical plane defined by the feed wire centerline in the wire guide.

5. The coiling machine of claim 4, wherein the wire guide has a groove parallel to the panel for guiding the wire against the tapered nose of the form arbor.

6. The coiling machine of claim 5, wherein the feed wire is of square cross section and the groove in the wire guide comprises an inverted v notch for guiding the wire to the form arbor with the edges of the wire in a substantially vertical and horizontal orientation.

7. A spring coiling machine having a front panel including a coiling station, comprising:

(a) a form arbor having a nose projecting from the panel;

(b) a block wire guide in close vertical spaced relation to the form arbor;

(c) a coiling point in close side spaced relation to the form arbor;

(d) a pitch tool in close side spaced relation to the form arbor, opposite the coiling point;

(e) means for feeding a supply of wire between the wire guide and the form arbor, between the coiling point and the form arbor and against the pitch tool, such that during said feeding the wire is plastically deformed into a coil having a series of adjacent generally helical turns;

(f) blade means operative downstream of the coiling point for severing a coil from the supply of wire;

(g) means for controlling the position of the coiling point during coil formation, to produce a coil having turns of different diameter;

(h) a retractable cutting arbor situated between the form arbor and the blade means, the cutting arbor operative in retracted position within the panel during the forming of small diameter turns, and movable to an active position projecting from the panel into a large diameter turn to provide a cutting mandrel against which the blade means can sever said large diameter turn from the supply of wire; and a deflection member supported by the panel and facing substantially downward toward the cutting arbor, for stopping said large diameter turn as said turn is lifted away from the cutting arbor during the severing action of the cutting blade on said turn.

8. A tool assembly for installation in the coiling station of a spring coiling machine comprising:

a tool holder having a front face containing a plurality of holes for mounting tools to project from said face, two of said holes being spared apart substantially vertically;

a first arbor having a first stem mounted in a first of said two holes, the first arbor including a stem axis, and a nose portion having an arcuate profile when viewed along the stem axis and a tapered profile when viewed transversely to the stem axis, said taper terminating in a point offset from and oriented substantially parallel to the stem axis;

a second arbor having a second stem mounted for reciprocating motion in the second of said two holes, the second arbor having a stem axis and a nose portion including a point offset from and substantially parallel to the stem axis;

wherein the first an second stems are mounted so that the points of the first and second arbors are substantially vertically aligned between the stem axes.

9. The tool assembly of claim 8, wherein the arcuate tapered portion of the first arbor extends smoothly from said point to said stem.

10. The tool assembly of claim 8, wherein said second arbor is a pencil arbor.

11. The tool assembly of claim 10, wherein the pencil arbor includes a flat cutting plane oriented transversely to the stem axis, and wherein the stem of the pencil arbor is mounted so that the cutting plane lies substantially vertically aligned with the centers of said two holes.

12. The tool assembly of claim 11, wherein the points of both said arbors are at substantially the same distance from said face when the second arbor is in the extended position.

13. The tool assembly of claim 8, wherein in any plane parallel to said face taken through the nose portions when the second arbor is in the extended position, the cross sectional area of the nose portion of the second arbor is greater than the cross sectional area of the nose portion of the first arbor.

14. A tool assembly for installation in the coiling station of a spring coiling machine, comprising:

a tool holder having a front face containing a plurality of holes for mounting tools to project from said face, two of set holes being spaced apart substantially vertically;

a first arbor having a first stem mounted in a first of said two holes;

a second arbor having a second stem mounted for reciprocating motion in the second of said two holes; and a wire guide holder mounted in a third hole adjacent the first arbor, the holder including a deflection member having a deflection surface spaced form said face a distance equal to at least the projection distance of the second arbor in the extended position and located at an elevation between the axes of said first and second arbors.

15. A tool assembly for installation in the coiling station of a spring coiling machine, comprising:

a tool holder having a front face containing a plurality of holes for mounting tools to project from said face, two of said holes being spaced apart substantially vertically;

a first arbor having a first stem mounted in a first of said two holes, the first arbor including a stem axis and a nose portion including a point offset from the stem axis and an arcuate, tapered portion having a taper angle extending from the point toward the stem, of less than 45 degrees;

a second arbor tool having a second stem mounted for reciprocating motion in the second of said two holes;

said first and second stems being mounted so that the point on the nose of the first stem is between the first stem axis and the second arbor.

16. The tool assembly of claim 15 wherein the taper angle is about 40 degrees.

17. A method of forming a spring with a spring coiling machine, the machine having a plurality of components including a tool holder, means for feeding wire to the tool holder, a coiling point, a cutter blade, and control means for timing the sequential operation of the machine components, comprising the steps of:

(a) mounting a stationary form arbor in the tool holder;

(b) mounting a cutting arbor adjacent the form arbor, for reciprocal movement into and out of the tool holder in parallel with the form arbor;

(c) mounting a block wire guide in the tool holder adjacent the form arbor on the side thereof opposite the cutting arbor;

(d) feeding wire having a square cross section between and in contact with the guide, the form arbor and the coiling point, so that the wire is tilted against the form arbor as the wire passes between the wire guide and the form arbor to plastically bend the leading end of the wire into a first turn having a first radius of curvature;

(e) retracting the cutting arbor into the tool holder while the wire is continuously fed and deformed into a plurality of helical turns including the turn having the minimum spring diameter;

(f) moving the coiling point away from the form arbor to produce helical turns of increasing diameter;

(g) extending the cutting arbor into a predetermined last turn of increased diameter;

(h) interrupting the feed of wire;

(i) actuating the cutter blade to pinch said last turn against the cutting arbor, whereby a completed spring is severed from the coiling machine; and (j) restarting the feed wire and repeating the steps (d-i).

18. The method of claim 17, wherein the tilting step is accomplished by providing an arcuate tapered nose portion on the form arbor, the taper angle being less than 45 degrees from the axis of the arbor, said tapered portion facing said wire guide.

19. The method of claim 18, further including the step of deflecting the last turn during the cutting step, to influence the characteristics of the trailing cut edge of said last turn.

* * * * *